US009418538B2

(12) United States Patent
Antos

(10) Patent No.: US 9,418,538 B2
(45) Date of Patent: Aug. 16, 2016

(54) SELF-CONTAINED, POCKET-SIZED PRESENTATION APPARATUS

(76) Inventor: Jeffrey D. Antos, Scituate, MA (US)

( * ) Notice: Subject to any disclaimer, the term of this patent is extended or adjusted under 35 U.S.C. 154(b) by 2505 days.

(21) Appl. No.: 12/187,484

(22) Filed: Aug. 7, 2008

(65) Prior Publication Data

US 2009/0046058 A1 Feb. 19, 2009

Related U.S. Application Data

(60) Provisional application No. 60/955,792, filed on Aug. 14, 2007.

(51) Int. Cl.
*G08C 17/02* (2006.01)

(52) U.S. Cl.
CPC ..... *G08C 17/02* (2013.01)

(58) Field of Classification Search
CPC ..... G08C 17/02; G06F 3/01
USPC ..... 345/156, 158, 172; 348/552; 725/131
See application file for complete search history.

(56) References Cited

U.S. PATENT DOCUMENTS

| | | | | |
|---|---|---|---|---|
| 5,712,658 | A | 1/1998 | Arita et al. | |
| 5,727,060 | A | 3/1998 | Young | |
| 6,211,870 | B1 * | 4/2001 | Foster | 715/744 |
| 6,346,933 | B1 | 2/2002 | Lin | |
| 6,545,587 | B1 * | 4/2003 | Hatakeyama et al. | 340/3.31 |
| 6,636,199 | B2 | 10/2003 | Kobayashi | |
| 6,698,897 | B2 | 3/2004 | Hamana et al. | |
| 6,773,192 | B1 | 8/2004 | Chao | |
| 6,979,210 | B2 | 12/2005 | Regen et al. | |
| D568,313 | S | 5/2008 | Leung | |
| 2003/0090472 | A1 * | 5/2003 | Im | 345/172 |
| 2004/0095312 | A1 | 5/2004 | Chen | |
| 2004/0100446 | A1 * | 5/2004 | Bronson | 345/169 |
| 2005/0066069 | A1 * | 3/2005 | Kaji | 710/1 |
| 2005/0086241 | A1 * | 4/2005 | Ram et al. | 707/100 |
| 2005/0154815 | A1 * | 7/2005 | Molander et al. | 710/302 |
| 2006/0033653 | A1 | 2/2006 | Huang et al. | |
| 2006/0212319 | A1 * | 9/2006 | Strothmann et al. | 705/5 |
| 2006/0218549 | A1 * | 9/2006 | Hsu et al. | 717/174 |
| 2006/0250787 | A1 | 11/2006 | Ho et al. | |
| 2007/0094439 | A1 * | 4/2007 | Kumar et al. | 711/103 |
| 2007/0132733 | A1 * | 6/2007 | Ram | 345/163 |
| 2008/0062137 | A1 | 3/2008 | Brodersen et al. | |
| 2008/0117026 | A1 | 5/2008 | Hupfer et al. | |

* cited by examiner

*Primary Examiner* — Shaheda Abdin
(74) *Attorney, Agent, or Firm* — Davis, Malm & D'Agostine, P.C.

(57) ABSTRACT

A self-contained, pocket-sized presentation apparatus includes a USB drive having a housing, a memory, a processor, and protective cover. A user input device, wireless transmitter, and power source, are integrally disposed within the cover, the transmitter being operatively engaged with the input device and configured to selectively transmit wireless signals in response to selective user actuation of the input device. A wireless receiver is disposed within the housing of the USB drive, to receive and couple wireless signals from the transmitter to the USB drive. The USB drive is configured to receive the wireless signals from the wireless receiver, to selectively generate Page Up and Page Down instructions responsive thereto, and to send the Page Up and Page Down instructions via the USB plug. The memory is configured to contain computer readable program code therein, in the form of a presentation, and in the form of a portable presentation application.

14 Claims, 4 Drawing Sheets

SELF-CONTAINED, POCKET-SIZED PRESENTATION APPARATUS

RELATED APPLICATION

This application claims the benefit of U.S. Provisional Application Ser. No. 60/955,792, entitled USB Drive with Wireless Slide Advance, filed on Aug. 14, 2007, the contents of which are incorporated herein by reference in their entirety for all purposes.

BACKGROUND

1. Technical Field

This invention relates to presentation equipment, and more particularly to a self-contained, pocket sized presentation device with wireless slide advance.

2. Background Information

Presentations have long been used as a convenient tool to convey information in business, personal, as well as academic life. More recently, with highly developed computer technologies, a computer screen has been widely utilized as a convenient medium for presenting information to an audience. The use of computer-implemented presentations has become particularly popular due to the popularity of presentation software such as the PowerPoint™ application by Microsoft® Corporation (Redmond, Wash.).

If presented to relatively small audiences, these presentations may be displayed on the screen of a personal computing device such as a desktop or notebook computer, or even a handheld device such as a cell phone or PDA. However, when presented to a larger audience, such as in a conference center or auditorium, presentations are generally outputted from a host computer onto a large screen, such as by a projector coupled to the host computer, or onto a large wall mounted flat panel display. In these latter instances, a presenter may electronically forward the presentation as a data file e.g., in .ppt (PowerPoint™) format or the like, to the venue, where an organizer may upload the presentation onto the host computer. Then, at the venue, the presenter may operate the host computer to open and display the .ppt presentation on the screen.

In such a large venue, the presenter (e.g., a teacher or a reporter) generally stands in front of the audience, next to or in front of the screen. The presenter may stand in a fixed location, e.g., at a podium, or may move among various locations while presenting. In these instances, an assistant is usually required to actuate the "Page Up" and "Page Down" keys on the computer to proceed through the presentation.

Disadvantageously, there are times in which what is displayed on the screen is not what is wanted by the presenter, and substantial time may be wasted in correcting the display. Other disadvantages associated with the foregoing approach include the possibility of the .ppt presentation becoming corrupted or damaged during emailing to the venue, or of the presentations becoming lost or damaged due to human error of the personnel at the venue. Moreover, the presenter may make last minute changes to the presentation, which would not be reflected in the version previously sent to the venue.

In an attempt to avoid these potential pitfalls, the presenter may save the presentation onto portable media, and personally bring the media to the venue, for use in the host computer. While this may help eliminate some of the foregoing issues, one still runs the risk that the media may be of the wrong format or version, or otherwise incompatible with the hardware or software of the host machine. Moreover, even if the presentation is able to be properly read and displayed by the host computer, the presenter may still be effectively tethered to the host computer, or be required to employ an assistant, in order to manually actuate the "Page Up" and "Page Down" keys. And, while some host computers may be equipped with remote controls to remotely actuate the "Page Up" and "Page Down" keys, such remotes tend to become easily lost or broken, and as such, their availability can not be relied upon by visiting presenters.

A need therefore exists for an improved presentation apparatus that addresses one or more of the foregoing unresolved issues.

SUMMARY

In one aspect of the present invention, a self-contained, pocket-sized presentation apparatus includes a USB drive having a housing, a memory, a processor, a USB plug configured for engagement with a USB receptacle of a host computer, and a protective cover configured for removable engagement with the USB plug. At least one user input device, a wireless transmitter, and a power source, are integrally disposed within the cover, the transmitter being operatively engaged with the input device and configured to selectively transmit a plurality of wireless signals in response to selective user actuation of the input device. A wireless receiver is disposed within the housing and operatively engaged with the USB drive, to receive and couple wireless signals from the transmitter to the USB drive. The USB drive is configured to receive the wireless signals from the wireless receiver, to selectively generate USB compliant Page Up and Page Down instructions responsive thereto, and to send the Page Up and Page Down instructions via the USB plug. Computer readable program code is stored in the memory, and defines a presentation application configured to access presentation data for display by the host computer. The memory is also configured for storing computer readable program code defining presentation data accessible by the computer, and the apparatus has a pocket-sized form factor.

In another aspect of the invention, a self-contained, pocket-sized presentation apparatus includes a USB drive having a housing, a memory, a processor, a USB plug configured for receipt within a USB receptacle of a computer, and a protective cover configured for removable engagement with the USB plug. At least one user input device, a wireless transmitter, and a power source, are integrally disposed within the cover, the transmitter being operatively engaged with the input device and configured to selectively transmit a plurality of wireless signals in response to selective user actuation of the input device. A wireless receiver is disposed within the housing and operatively engaged with the USB drive, to receive and couple wireless signals from the transmitter to the USB drive. The USB drive is configured to receive the wireless signals from the wireless receiver, to selectively generate Page Up and Page Down instructions responsive thereto, and to send the Page Up and Page Down instructions via the USB plug. The memory is configured to contain computer readable program code therein, in the form of a presentation, and in the form of a portable presentation application, and the apparatus has a pocket-sized form factor.

In a still further aspect of the invention, a method of deploying a self-contained, pocket-sized presentation apparatus includes providing a USB drive having a housing, a memory, a processor, a USB plug configured for receipt within a USB receptacle of a computer, and a protective cover configured for removable engagement with the USB plug. At least one user input device, a wireless transmitter, and a power source, are integrally disposed within the cover. The transmitter is operatively engaged with the input device and configured to selectively transmit a plurality of wireless signals in response to selective user actuation of the input device. A wireless receiver is disposed within the housing in operative engagement with the USB drive. The wireless receiver is configured to receive and couple wireless signals from the transmitter to the USB drive, which is configured to receive the wireless signals from the wireless receiver, to selectively generate Page Up and Page Down instructions responsive thereto, and to send the Page Up and Page Down instructions via the USB plug. The memory is configured to contain computer readable program code therein, in the form of a presentation and in the form of a portable presentation application. The apparatus is configured to have a pocket-sized form factor.

The features and advantages described herein are not all-inclusive and, in particular, many additional features and advantages will be apparent to one of ordinary skill in the art in view of the drawings, specification, and claims. Moreover, is should be noted that the language used in the specification has been principally selected for readability and instructional purposes, and not to limit the scope of the inventive subject matter.

DETAILED DESCRIPTION

Figure 1A:
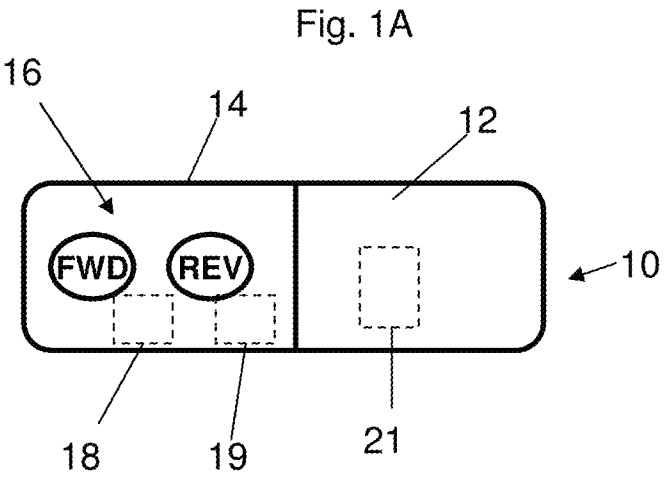
FIG. 1A is a schematic top view of a presentation apparatus according to an embodiment of the present invention.

In the following detailed description, reference is made to the accompanying drawings that form a part hereof, and in which is shown by way of illustration, specific embodiments in which the invention may be practiced. These embodiments are described in sufficient detail to enable those skilled in the art to practice the invention, and it is to be understood that other embodiments may be utilized. It is also to be understood that structural, procedural and system changes may be made without departing from the spirit and scope of the present invention. In addition, well-known structures, circuits and techniques have not been shown in detail in order not to obscure the understanding of this description. The following detailed description is, therefore, not to be taken in a limiting sense, and the scope of the present invention is defined by the appended claims and their equivalents. For clarity of exposition, like features shown in the accompanying drawings are indicated with like reference numerals and similar features as shown in alternate embodiments in the drawings are indicated with similar reference numerals.

Briefly described, an embodiment of the present invention includes a self-contained, pocket size presentation apparatus in the form of a USB drive (also known as a flash drive, jump drive or memory stick) that plugs into the USB port of a computer, and which may be used to store a presentation, such as a conventional .ppt presentation, optionally along with a copy of a presentation application (e.g., a full or portable version of Microsoft® PowerPoint™, or similar/compatible applications). The drive includes a removable cap that serves to protect the USB plug from physical damage and/or static electricity. This cap, however, is modified to include a wireless (e.g., IR or RF) remote slide advance mechanism, which communicates with a receiver built into the drive, for communication with the host computer via the USB port.

In operation, a user may simply store a presentation (and optionally, the presentation application) onto the drive, and plug it into a USB port of a host computer located at a conference room or other presentation venue. For example, the host computer may be connected to a projector, to display the presentation on a large screen. The user may simply bring the cap to a podium or other location away from the computer, and depress 'forward' or 'reverse' buttons integrated therein, which send signals to the receiver in the drive which sends "Page Up" and "Page Down" keyboard signals via the USB port to respectively advance or reverse the presentation.

Embodiments of the present invention thus provide a unitary, self-contained and pocket-sized device upon which a user may store a presentation along with software application capable of displaying the presentation. A user may simply bring the device to the host venue, remove the cap from the device, and plug the base/housing into an available USB port of the host computer. The host computer then automatically recognizes the device in a conventional manner, and either accesses the presentation with a pre-installed application (e.g., PowerPoint™) or permits an application stored on the device 10 to run without having to either install any applications onto the host computer, or rely on any presentation applications previously loaded onto the host computer. The presentation is then displayed by the host computer, and the user may actuate the fwd and rev buttons on the cap 14 to wirelessly cycle through the presentation slides.

Where used in this disclosure, the term "computer" is meant to encompass a workstation, personal computer, personal digital assistant (PDA), wireless telephone, or any other suitable computing device. The acronym "USB" refers to the Universal Serial Bus specification standardized by the USB Implementers Forum (USB-IF). The term "pocket-sized" refers to substantially any size or form factor typically associated with being conveniently carried within a pocket, such as those of a pen, key fob, cell phone, PDA or deck of playing cards. "Pocket-sized" thus generally refers to dimensions at or below about 6"×3"×1", and in particular embodiments, at or below about 3"×1"×0.5".

Aspects of exemplary systems and methods embodying the present invention can be programmed in any suitable language and technology, including, but not limited to: C++; Visual Basic; Java; VBScript; Jscript; BCMAscript; DHTM1; XML, CGI, Hypertext Markup Language (HTML), Active ServerPages (ASP) and Javascript. Alternative versions maybe developed using other programming languages.

Referring now to the Figures, embodiments of the present invention will be more thoroughly described. As shown in FIG. 1A, an embodiment of the present invention includes a self-contained, pocket-sized presentation module 10 in the form factor of a conventional USB drive disposed within a housing 12 having a protective cap 14 configured for removable engagement with the USB plug portion (FIG. 2) thereof. As also shown, the cap 14 includes a user input device, in the form of one or more buttons 16. The buttons are coupled to an integral wireless transmitter 18 (and power source 19) such as shown in phantom, and as described in greater detail hereinbelow with respect to FIG. 3.

In addition to a conventional USB drive (FIG. 2), housing 12 includes a wireless receiver operatively engaged therewith, such as shown and described below with respect to FIG. 4. The wireless receiver is configured to receive and couple wireless signals from the transmitter of cap 14, to the USB drive of housing 12, such as when deployed as shown in FIG. 1B.

Figure 1B:
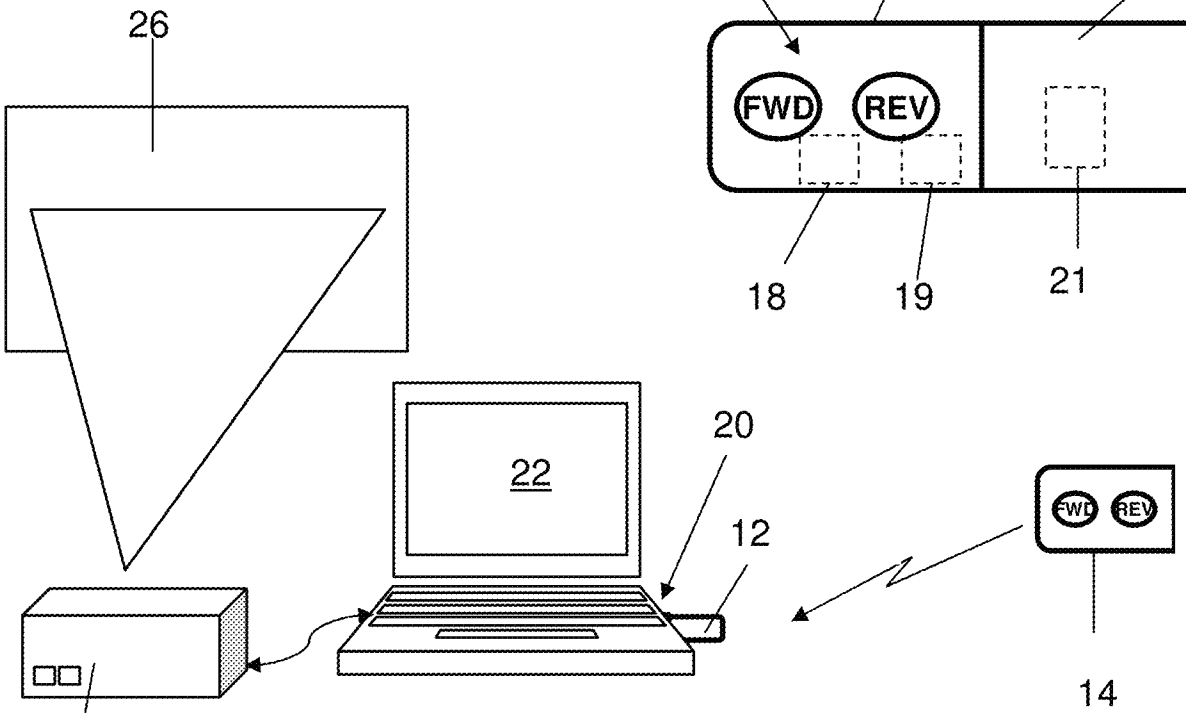
FIG. 1B is a schematic perspective, partially exploded, view of an exemplary application employing the embodiment of FIG. 1A.

Turning now to FIG. 1B, in a representative application, cap 14 is removed from housing 12 to expose the plug (FIG. 2) of the USB drive. The USB drive, which has previously been loaded with a presentation, e.g., in .ppt format (and optionally, a software application such as PowerPoint™), is then inserted into an available USB port 20 of the host computer 22 as shown.

The operating system of the host computer 22 then automatically recognizes the USB drive in a conventional manner, and then in some embodiments, permits the presentation stored thereon to be accessed by a presentation software application resident on the host computer 22. Optionally, a presentation software application stored on the device 10 is permitted to run and access the presentation. The host computer then outputs the presentation slides to a display device such as a projector 24 and screen 26 as shown. The user may actuate the fwd and rev buttons on the cap 14 to wirelessly cycle through the presentation slides.

Thus, embodiments of the present invention permit a user to conveniently transport a presentation to a particular venue, along with sufficient hardware and software for displaying and remotely cycling through the presentation slides, using substantially any host computer having a USB port. Moreover, these embodiments enable the presentation to be displayed nominally without leaving any information on the host computer, since the presentation may be displayed without having to install or use any applications on the host computer. These embodiments also provide the presenter with the peace of mind of knowing that the safety of the presentation enroute to the presentation venue, as well as the ability to successfully display and cycle through the presentation at the venue, is not dependent on the availability or technical ability of host personnel at the venue, or on the particular version of software application installed on the host computer. The presenter may also be assured that any last minute changes to the presentation are accurately reflected in the version presented.

Figures 2A, 2B:
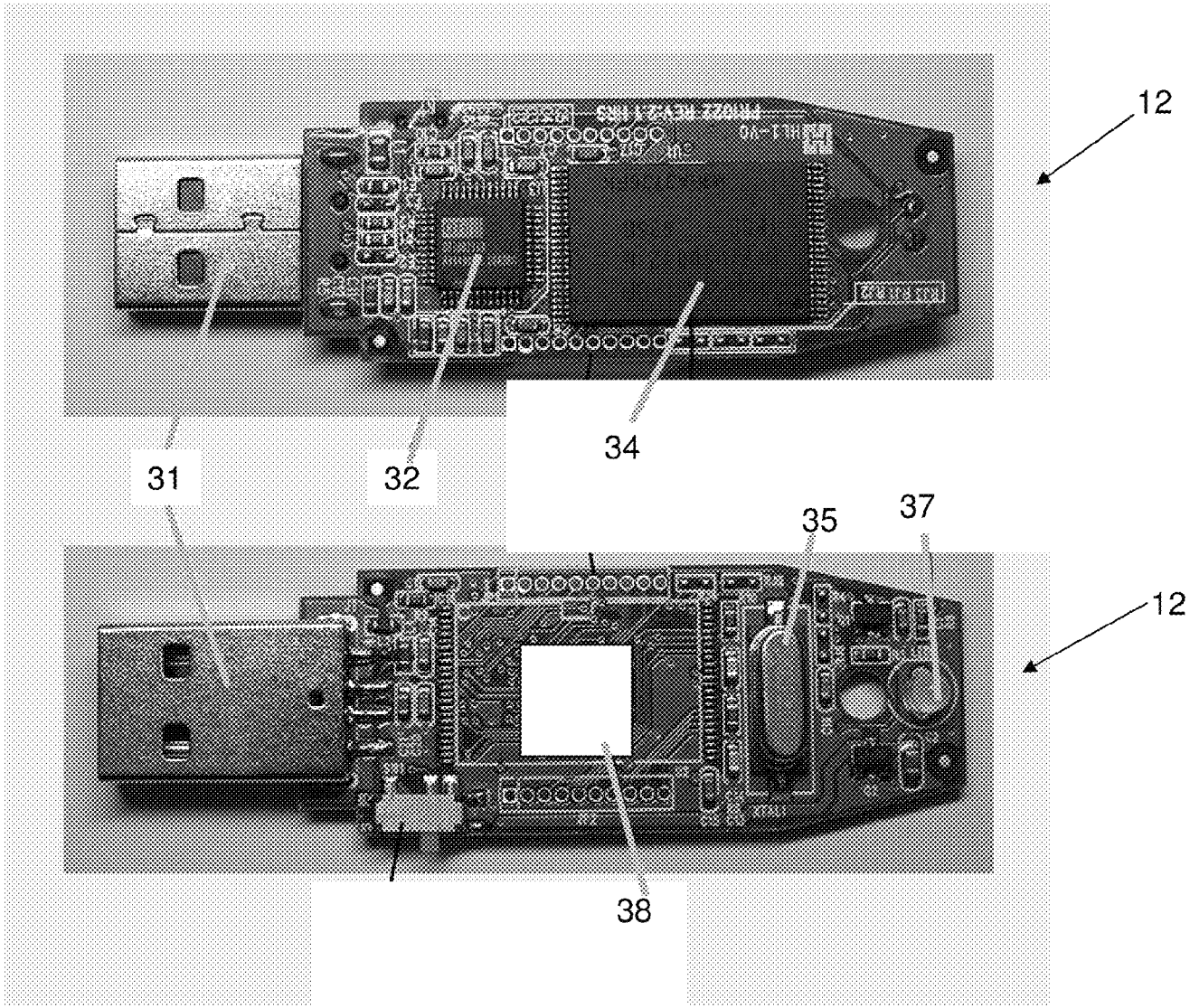
FIG. 2A is a top view, with a portion of the housing removed, of the USB drive portion of the presentation apparatus of FIGS. 1A-1B.
FIG. 2B is a bottom view, with a portion of the housing removed, of the USB drive portion of the presentation apparatus of FIGS. 1A-2A.

Turning now to FIG. 2, as mentioned hereinabove, housing 12 includes components of a conventional USB drive (or "flash drive), including a USB (e.g., 'type-A') connector 31 configured for receipt within a USB receptacle of a host computer, and a processor 32 (e.g., a USB mass storage controller, to implement a USB host controller). In particular embodiments, the processor 32 is a conventional RISC microprocessor including some on-chip ROM and RAM. The USB drive also includes memory 34, such as a conventional NAND flash memory chip. An oscillator 35 produces the device's main (e.g., 12 MHz) clock signal. Optionally, an LED 37 may be provided to indicate when the device is operational, e.g., when the device is making reads or writes. USB drives suitable for use in embodiments of the present invention include substantially any memory device which is compliant with the USB specification standardized by the USB Implementers Forum (USB-IF). As discussed hereinabove, in addition to these conventional USB drive components, embodiments of the present invention include an integral wireless receiver integrated into the housing 12. This receiver may be configured to receive substantially any type of wireless signal, including infrared (IR) or radio frequency (RF). The wireless receiver may be incorporated into the processor 32, including its on-chip ROM and/or RAM, or alternatively, may be embodied in a separate chip 38, such as disposed on the opposite side of the USB drive from processor 32 and memory 34 as shown.

Figure 3:
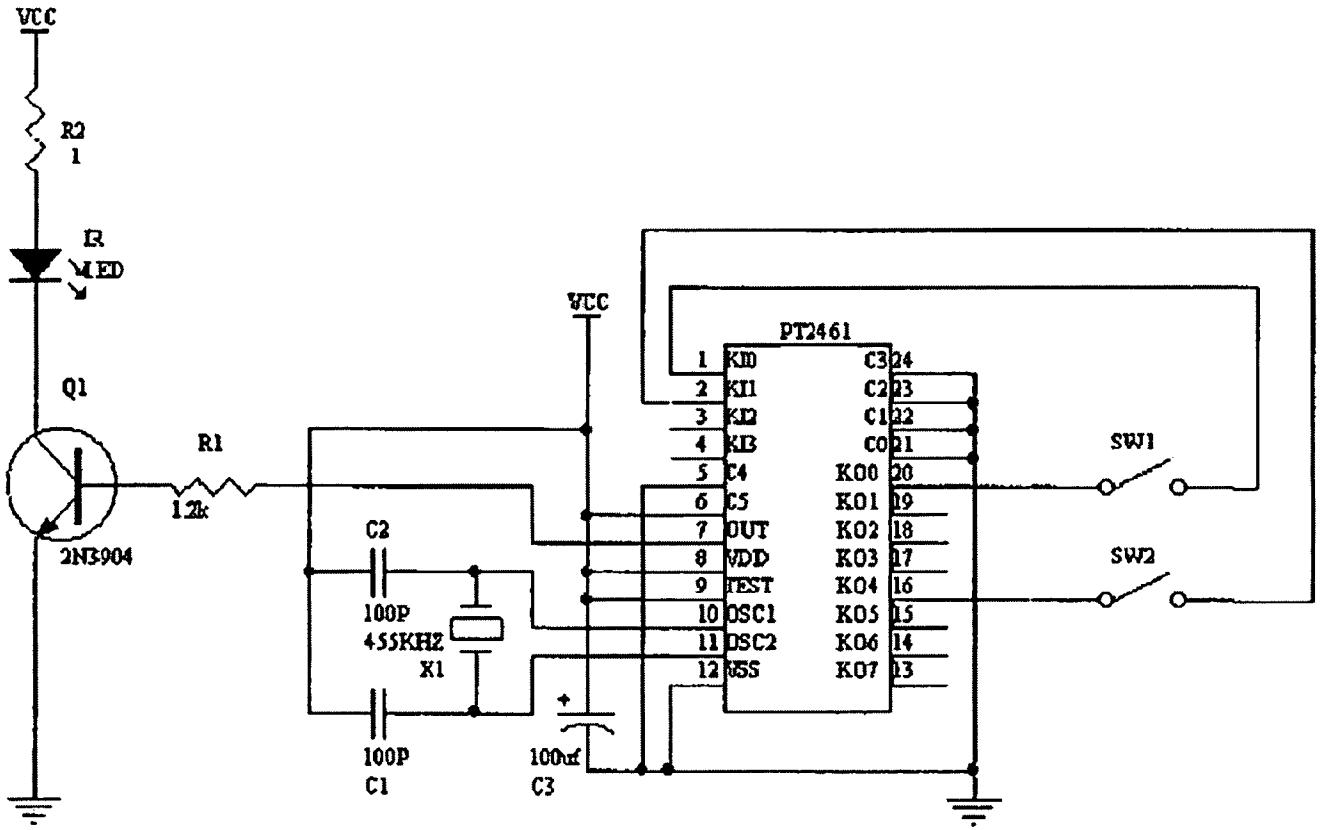
FIG. 3 is an exemplary signal emission circuit diagram for a transmitter portion of the embodiment of FIGS. 1A-2B.

Referring now to FIG. 3, an exemplary infrared signal emission circuit diagram is shown, which may be used to fabricate the wireless transmitter of cap 14 (FIGS. 1A, 1B). As shown, the infrared signal emission circuit supplies a voltage Vc (e.g., from a battery, not shown) to a microprocessor IC, which is a processor capable of emitting an encoded infrared signal. When the FWD or REV switches are pushed, a transistor Q1 is actuated to cause an infrared-emitting diode IR to emit an encoded infrared signal, which is transmitted to and received by the receiver of housing 12, which is connected to host computer 22 via universal serial bus (USB) connector 31 to page the presentation on display on the screen 26 either up or down, respectively.

Those skilled in the art, in light of the instant disclosure, will readily recognize any number of commercially available processors may be used to implement the wireless transmitter of cap 14. One relatively simple representative example is shown in FIG. 3, and includes a remote control CMOS (Complementary Metal-Oxide Semiconductor) transmitter configured to emit an infrared ray, and which has 24 pins. A signal is output via one of the pins from KO0 to KO7, and is input via one of the pins from KI0 to KI3. As shown in FIG. 3, when the FWD switch SW1 is pushed, a signal is output at the pin KO0 and input at the pin KI0. At this point, the microprocessor IC will output a code to an infrared module IR which is transmitted therefrom. When the REV switch SW2 is pushed, the signal is output at the pin KO4 and input at the pin KI1. At this point, the microprocessor IC will output another code to the infrared module IR which is transmitted therefrom.

Figure 4:
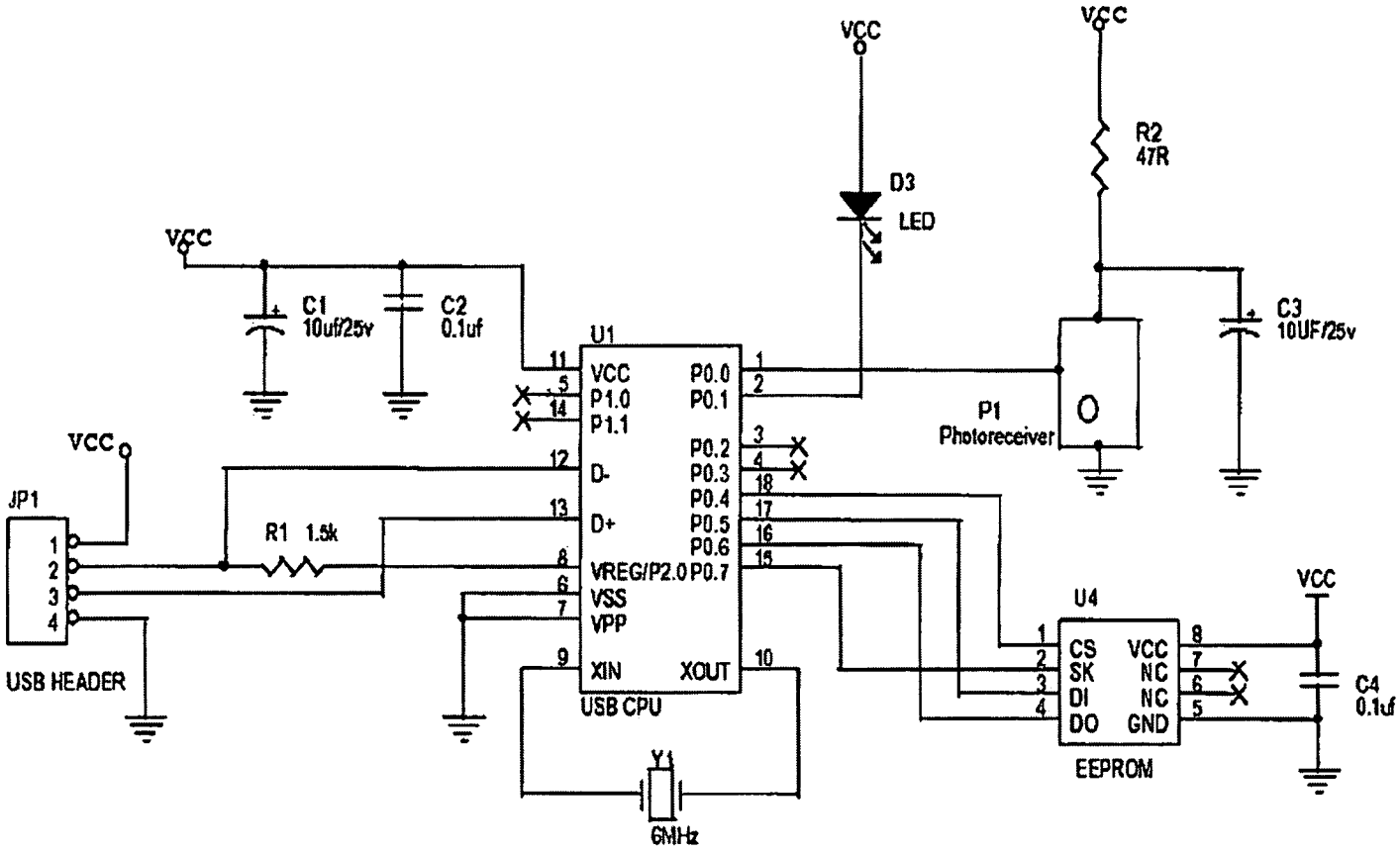
FIG. 4 is an exemplary circuit diagram for a corresponding receiver portion of the embodiment of FIGS. 1A-3.

Turning now to FIG. 4, a circuit diagram for an exemplary receiver suitable for use in housing 12 is shown and described. As shown, receiver 38 is a photo-receiver P1 for receiving an infrared signal transmitted from cap 14. The received infrared signal is input to a central processor U1, where the signal is decoded to emulate a mouse-controlled Page Up signal and be input to a computer. When a receiving module in the receiver P1 shown in FIG. 4 receives an infrared signal transmitted from the infrared module IR of FIG. 3, the received signal is compared to determine whether it matches with a preset code or not. When the received signal is determined as matching with the code obtained by pushing the first switch SW1, a signal emulating the function of Page Up is sent out via an interface of the USB connector 31 to the host computer 22 to page the screen as described hereinabove. Similarly, when the received signal is determined as matching with the code obtained by pushing the second switch SW2, a signal emulating the function of Page Down is sent out via the interface of the USB connector 31 to the host computer 22 to page the presentation to the next slide.

It should be understood that device 10, including housing 12 and cap 14 is not necessarily limited to a configuration as shown in FIG. 1A, but rather, these elements may be fabricated in substantially any pocket-sized form factor, such as that of a pen, key fob, and the like, without departing from the scope of the present invention. Moreover, although the embodiments disclosed herein may be conveniently powered by a battery, i.e., a battery embedded within the housing 12 and within the cap 14, these elements may be powered in nominally any convenient manner, such as by solar cells integrated into the surface of the housing and/or cap, miniature fuel cells, by physical connection to an external power supply, and/or combinations thereof. It should also be recognized that although the USB drive shown and described herein has a physical USB plug configured for receipt within a USB port of a host computer, the USB plug may connect to the host computer in a non-physical, manner, e.g., wirelessly, without departing from the scope of the present invention. For example, rather than a physical plug, the USB drive may connect to a host computer using a virtual USB plug in the form of a wireless module 21, shown in phantom in FIG. 1A, such as one configured to implement a wireless USB protocol, or similar Bluetooth, Wi-Fi or other IEEE standard that currently exists or that may be developed in the future, operating in any medium including IR, RF, etc. These simple and functionally equivalent alternatives should be included in the scope of the present invention.

Embodiments of the invention having been described, an exemplary method of the present invention is shown and described with respect to the following Table I.

TABLE I

| | |
|---|---|
| 50 | providing a USB drive having a protective cover |
| 52 | user input device, wireless transmitter, and power source integrated into cover |
| 54 | Transmitter operatively engaged with the input device |
| 56 | wireless receiver disposed within the housing in operative engagement with the USB drive |
| 58 | wireless receiver configured to receive and couple wireless signals to the USB drive |
| 60 | USB drive configured to generate and send Page Up and Page Down instructions to a host computer in response to the received wireless signals |
| 62 | wherein the memory is configured to contain computer readable program code therein, in the form of a presentation and in the form of a portable presentation application. |

As shown, a method of fabricating a self-contained, pocket-sized presentation apparatus includes providing 50 a USB drive having a housing, a memory, a processor, a USB plug configured for receipt within a USB receptacle of a computer, and a protective cover configured for removable engagement with the USB plug. A user input device, wireless transmitter, and power source are each integrated 52 into the cover. The transmitter is operatively engaged 54 with the input device to selectively transmit wireless signals in response to selective user actuation of the input device. At 56, a wireless receiver is disposed within the housing in operative engagement with the USB drive. At 58, the wireless receiver is configured to receive and couple the wireless signals to the USB drive. The USB drive is configured 60 to receive the wireless signals from the wireless receiver, to selectively generate Page Up and Page Down instructions responsive thereto, and to send the Page Up and Page Down instructions via the USB plug. The presentation apparatus is thus configured to enable a presentation and/or presentation software application to be loaded onto the memory of the USB drive, with the presentation slides being advanced wirelessly by actuating the user interface within the cover.

It should be understood that any of the features described with respect to one of the embodiments described herein may be similarly applied to any of the other embodiments described herein without departing from the scope of the present invention.

In the preceding specification, the invention has been described with reference to specific exemplary embodiments for the purposes of illustration and description. It is not intended to be exhaustive or to limit the invention to the precise form disclosed. Many modifications and variations are possible in light of this disclosure. It is intended that the scope of the invention be limited not by this detailed description, but rather by the claims appended hereto.

Having thus described the invention, what is claimed is:

1. A self-contained, pocket-sized presentation apparatus comprising:

a USB drive having a housing, a memory, a processor, a USB plug configured for connection with a computer, and a protective cover configured for removable engagement with the housing;

at least one user input device, a wireless transmitter, and a power source, integrally disposed within the cover, the transmitter being operatively engaged with the input device and configured to selectively transmit a plurality of wireless signals in response to selective user actuation of the input device;

a wireless receiver disposed within the housing and operatively engaged with the USB drive;

the wireless receiver configured to receive and couple wireless signals from the transmitter to the USB drive;

the USB drive configured to receive the wireless signals from the wireless receiver, to selectively generate Page Up and Page Down instructions responsive thereto, and to send the Page Up and Page Down instructions via the USB plug; the memory containing computer readable program code therein, in the form of a presentation, and in the form of a portable presentation application; and wherein the apparatus has a pocket-sized form factor.

2. The apparatus of claim 1, comprising computer readable program code stored in the memory, defining presentation data accessible by the computer.

3. The apparatus of claim 1, comprising computer readable program code stored in the memory, defining a presentation application configured to access the presentation data for display by the computer.

4. The apparatus of claim 1, wherein the Page Up and Page Down instructions are compliant with the USB standard.

5. The apparatus of claim 4, wherein the processor is configured to receive the wireless signals from the receiver.

6. The apparatus of claim 5, wherein the processor is configured to generate the Page Up and Page Down instructions.

7. The apparatus of claim 1, wherein the virtual USB plug comprises a wireless connector.

8. A method of deploying a self-contained, pocket-sized presentation apparatus, the method including:

(a) providing a USB drive having a housing, a memory, a processor, a USB plug configured for connection with a computer, and a protective cover configured for removable engagement with the housing;

(b) within the cover, integrally disposing at least one user input device, a wireless transmitter, and a power source;

(c) operatively engaging the transmitter with the input device and configuring the transmitter to selectively transmit a plurality of wireless signals in response to selective user.

9. The method of claim 8, comprising storing computer readable program code in the memory, the computer readable program code defining presentation data accessible by the computer.

10. The method of claim 8, comprising storing computer readable program code in the memory, defining a presentation application configured to access the presentation data for display by the computer.

11. The method of claim 8, wherein the Page Up and Page Down instructions are generated as USB compliant instructions.

12. The method of claim 11, comprising configuring the processor to receive the wireless signals from the receiver.

13. The method of claim 12, comprising configuring the processor to generate the Page Up and Page Down instructions.

14. The method of claim 8, comprising configuring the virtual USB plug as a wireless connector.

* * * * *